United States Patent [19]

Baright

[11] 4,399,573

[45] Aug. 23, 1983

[54] REINFORCED BOX SPRING FRAME

[75] Inventor: Leslie I. Baright, Atlanta, Ga.

[73] Assignee: Simmons U.S.A. Corporation, New York, N.Y.

[21] Appl. No.: 123,261

[22] Filed: Feb. 21, 1980

[51] Int. Cl.[3] ..... A47C 23/04; A47C 23/06

[52] U.S. Cl. ..... 5/239; 5/264 B

[58] Field of Search ..... 5/236, 239, 264 R, 264 B, 5/246, 247, 248

[56] References Cited

U.S. PATENT DOCUMENTS

| | | | |
|---|---|---|---|
| 183,657 | 10/1876 | Forbes | 5/239 |
| 981,966 | 1/1911 | Ambrozy | 5/236 |
| 1,823,013 | 9/1931 | Wantz | 5/236 |
| 3,665,529 | 5/1972 | Slominski | 5/264 |
| 3,717,886 | 2/1973 | Watts | 5/239 |
| 3,755,833 | 9/1973 | Slominski | 5/247 |
| 3,824,639 | 7/1974 | Mandusky | 5/260 |
| 3,916,463 | 11/1975 | Higgins | 5/264 |
| 3,938,204 | 2/1976 | Slominski | 5/255 |
| 3,971,081 | 7/1976 | Roe | 5/246 |
| 3,992,732 | 11/1976 | Cervisi | 5/263 |
| 4,020,512 | 5/1977 | Pringle | 5/264 |
| 4,068,329 | 1/1978 | Gross et al. | 5/255 |
| 4,074,372 | 2/1978 | Schulz | 5/263 |

*Primary Examiner*—Alexander Grosz

*Attorney, Agent, or Firm*—Fitch, Even, Tabin, Flannery & Welsh

[57] ABSTRACT

A base frame for a box-spring which is reinforced by longitudinal beams secured to the upper surfaces of the cross slats within the spring assembly.

2 Claims, 2 Drawing Figures

REINFORCED BOX SPRING FRAME

This invention relates to base frames for box springs, and particularly to the reinforcement of such base frames to increase their resistance to deflection under load.

A "box spring", as the term is generally understood, is a resilient foundation for a mattress. It comprises a base frame surmounted by an assembly of wire springs, the upper surface of which is padded, and the whole encased within a pre-sewed box-like ticking tacked or stapled to the underside of the base frame around its periphery. A dust cover of light plastic film, or the like, is usually also applied to the underside of the base frame.

Spring assemblies found in box springs take a variety of forms, e.g., single-cone coils, double-cone coils, and, more recently, so-called wire torsion springs. In addition to these conventional commercial forms, the prior art suggests a variety of other forms of springs as well. As far as the present invention is concerned, the particular form of spring assembly employed in the box spring is of little importance.

The aim of the invention is to reinforce an otherwise conventional wooden base frame for box springs to stiffen it against deflection under the normally-encountered loads which are carried by that frame irrespective of the form of spring assembly provided.

Figure 1:
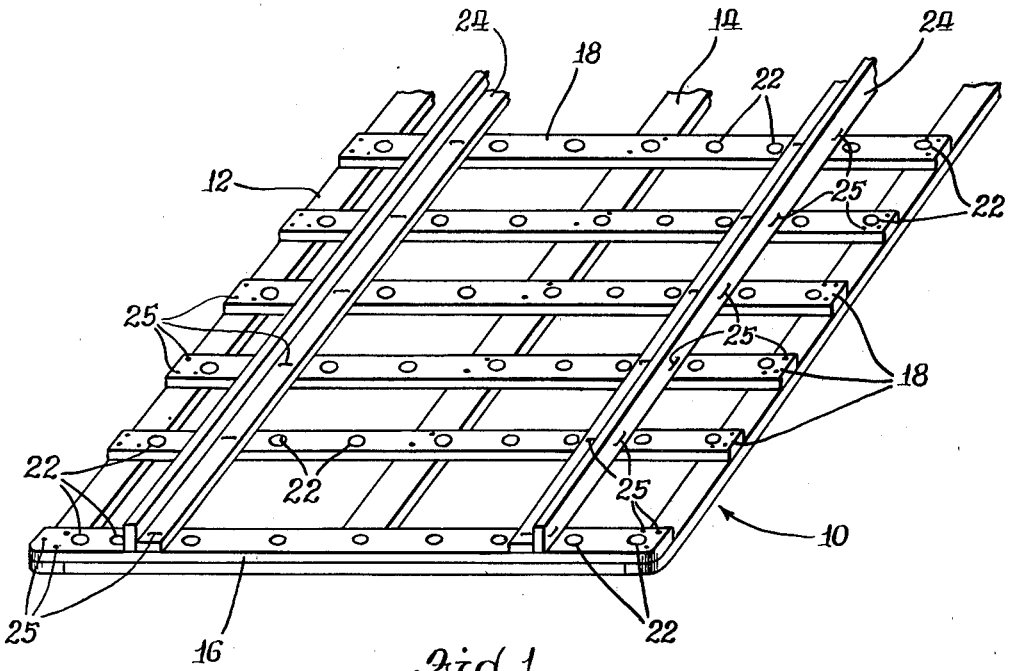
Figure 2:
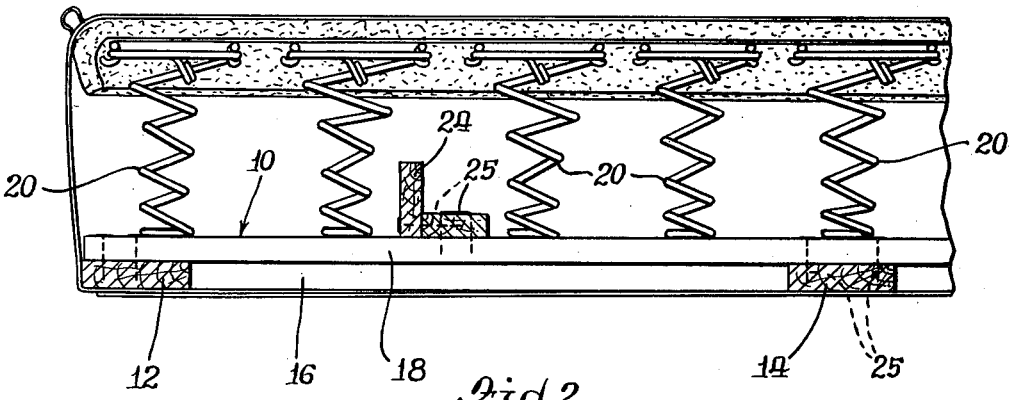

The invention and its purposes are explained in more detail in the following description, made with reference to the accompanying drawing in which:

FIG. 1 is a fragmentary isometric view of a base frame in accordance with the invention, isolated from its functional context for clarity of illustration; and FIG. 2 is a fragmentary cross sectional elevation of one form of box spring employing the base frame of FIG. 1.

THE PRE-EXISTING CONDITION ADDRESSED

Insofar as FIG. 1 shows a perimeter frame of flat lumber comprising side rails and end rails nailed together at the frame corners, spanned by numerous cross slats, and with or without a center rail, it could be regarded as quite conventional. From the standpoint of strength, such an unreinforced frame is adequate to carry reasonable loads even when supported only along its perimeter, as by a conventional rectangular bed frame of angle iron or the like.

However, the conventional wooden base frame described, while adequate in strength to carry normal loads when only peripherally supported, exhibits substantial resilient deflection under such load, and in time, i.e., after extended use, may develop a degree of permanent set as well. Such deflection, while not usually harmful to the box spring itself, interferes with its intended function of providing plane and level resilient foundation for the mattress.

The sagging of a box spring under load is reflected in the sagging of the mattress it carries, tilts the springs of the latter, if of the innerspring type, to interfere with the essential function of the mattress, that of accommodating itself to the support of the outstretched body notwithstanding the uneven distribution of the body's weight. Also, and particularly in foundations for mattresses which are relatively more flexible, e.g., mattresses of the Marshall type or of the resilient foam type, a permanent set or sag in the box spring is reflected as a depression in the surface of the mattress in a manner regarded by some as unsightly.

DESCRIPTION OF THE INVENTION

This shortcoming of otherwise conventional box springs is addressed by this invention in the illustrated form by the provision of frame-stiffening longitudinal beams secured to the upper surface of the cross slats of the base frame, where, within the confines of the spring assembly, they can be oriented for the most favorable disposition of the beam section without interfering with the resilient deflection of the foundation, and without altering the smooth outline either of the upholstered top surface, or of the undersurface, of the box spring.

In particular, the box spring base frame 10 of the invention comprises, in the full-width size, a pair of side rails 12 and a center rail 14, which may be of standard lumber of construction grade in nominal $1\times3$ size, connected at each end of the frame by an end rail 16 comprising a lower $1\times1\frac{3}{4}$ slat which butts the side rails 12 in the plane thereof, and an upper $1\times3$ board which spans the side rails.

A multiplicity of cross slats 18 spans the upper surfaces of the side rails 12 and center rail 14 between the two end rails. With the particular form of spring assembly illustrated in FIG. 2, i.e., an assembly of single-cone coils 20, each cross slat is positioned to support one transverse row of such coils, the positions of which are indicated by the circular imprints 22 on the cross slats in FIG. 1. The head-end and foot-end rows of springs are carried by the end rails.

All of the frame members are nailed or stapled together at their intersections by multiple nails or staples to integrate the individual members into a framework which is essentially rigid with respect to forces tending to rack the frame in its own plane.

Emplaced upon the cross slats 18 and extending longitudinally from end to end of the frame parallel to the side rails 12 is a pair of reinforcing beams 24 which are equally spaced from the center line of the frame and positioned between adjacent coil springs 20 on the cross slats and end rails.

The reinforcing beams 24, also of lumber in the illustrated form, are L-shaped, consisting of two wooden slats which are nailed or stapled together through the face of one of the slats into the edge of the other. Each reinforcing beam is oriented so that the slat which receives the connecting nail or staple 25 edgewise becomes the flange, and the other slat the upstanding web. This orientation stresses the nails or staples 25 in shear, avoiding the risk that they might pull out under load. The reinforcing beams 24 are then secured to the upper surfaces of the cross slats 18 and of end rails 16 by nailing or stapling through the flange to secure the reinforcing beams to every cross slat of the frame.

As indicated in FIG. 1, the reinforcing beams 24 are placed in facing relation to each other, and with the webs on the outside in the illustrated instance. It will be appreciated, however, that in the case of an L-shaped beam of relatively narrow compass, the webs may be placed interiorly or exteriorly with practically unmeasureable effect.

In the use of lumber as the structural material for the reinforcing beams 24, and particularly with the prescribed orientation of the beam section, i.e., with the nails or staples 25 driven through the face of the web edgewise into the flange, additional stiffening, if desired for the greater cross-slat span of a queen-size bed, may be readily obtained by deepening the web or by adding yet another web member to form a channel-shaped section. Depending upon the form of spring assembly employed and the degree of deflection of the spring assembly under load, a channel section may be found preferable to deepening the web member of the beam, or to increasing the number of separate beams.

To illustrate the effectiveness of the reinforced base frame shown in the drawing, it has been tested in comparison with a conventional base frame of otherwise identical construction without the reinforcing beams, and demonstrates marked reduction of frame deflection under identical loadings.

In particular, in response to a 200 pound sand-bag load on a one foot square area in the exact center of the frame, a conventional wooden base frame having $1\times3$ side rails, center rail, and end rails, and with seven $1\times1\frac{3}{4}$ cross slats, exhibited a deflection of three and five-eighths inches ($3\frac{5}{8}''$) when supported only at its ends, and a deflection of one and one-sixteenth inches (1-1/16") when supported only at its sides. On the other hand, the reinforced box spring frame of the invention, of the same size and with the same dimensions of its constituent side rails, center rail, end rails, and cross slats, under the identical loading, exhibited a deflection of only one inch (1") when supported only at its ends, and a deflection of only seven-eighth inches ($\frac{7}{8}''$) when supported only at its sides.

While the reduction of the deflection of the loaded frame when supported only at its ends might have been anticipated from the longitudinal orientation of the beams, their reduction of the measured deflection of the frame when supported only at its sides was not predictable. It presumably results from a shortening of the effective span of the cross slats, and the knitting of all of the cross slats into a mutually supporting whole so that notwithstanding the concentration of load at the center of the base frame, the load was distributed by the reinforcing beams to the more distant cross slats and even to the end rails.

In any event, when subjected, as previously described, to a 200 pound center load while supported by an angle-iron Hollywood bed frame, the conventional base frame deflected nine-sixteenth inches (9/16"), whereas the reinforced frame of FIG. 1 deflected only three-eighths inches ($\frac{3}{8}''$), i.e., only two-thirds the deflection of the conventional frame.

In summary, the simple addition of longitudinal reinforcing beams, which may be of the same material which is employed in the fabrication of a box spring base frame of otherwise conventional construction, has provided a frame of demonstrably greater resistance to deflection by bending, and one which is therefore capable of providing a box spring more adequately suited to its function of providing plane and level support for a mattress when the bed is occupied, as well as maintaining the trim appearance of the bed when not in use.

Features of the invention believed patentable are set forth in the following claims.

What is claimed is:

1. In a box-spring, a wooden base frame comprising a rectangular border and a plurality of cross-slats secured thereon for supporting an assembly of upholstery springs adapted when upholstered to provide resilient foundation for a mattress;

deflection-reducing reinforcement comprising at least one longitudinally-extending beam spanning the upper side of said frame from border to border atop the cross-slats and projecting upwardly from the cross-slats and between springs and within the assembly of springs thereon, said beam being formed of at least two wooden slats positioned respectively as an upstanding web and a flange extending laterally therefrom with the web positioned alongside the flange and secured thereto by metal fasteners driven through the face of the web into the edge of the flange, and said beam secured to each of said cross-slats.

2. The subject matter of claim 1 in which the beams are two in number, L-shaped, and spaced equidistantly from the longitudinal center-line of the frame, and the cross-sections of said beams are oriented for bilateral symmetry on said frame.

* * * * *

UNITED STATES PATENT AND TRADEMARK OFFICE

CERTIFICATE OF CORRECTION

PATENT NO. : 4,399,573

DATED : August 23, 1983

INVENTOR(S) : Leslie I. Baright

It is certified that error appears in the above-identified patent and that said Letters Patent is hereby corrected as shown below:

Column 4, line 36, after "beam" insert --being--.

Signed and Sealed this

*Twentieth* Day of *December 1983*

[SEAL]

*Attest:*

GERALD J. MOSSINGHOFF

*Attesting Officer*

*Commissioner of Patents and Trademarks*